US007147996B2

(12) United States Patent
Fitterman et al.

(10) Patent No.: US 7,147,996 B2
(45) Date of Patent: Dec. 12, 2006

(54) METHOD OF PROCESSING SILVER HALIDE MATERIALS

(75) Inventors: Alan S. Fitterman, Rochester, NY (US); Robert E. Dickerson, Hamlin, NY (US); Kenneth A. Duke, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 87 days.

(21) Appl. No.: 11/091,049

(22) Filed: Mar. 28, 2005

(65) Prior Publication Data

US 2006/0216658 A1 Sep. 28, 2006

(51) Int. Cl.
*G03C 5/18* (2006.01)
*G03C 5/26* (2006.01)
*G03C 5/38* (2006.01)

(52) U.S. Cl. ..... 430/449; 430/455; 430/459; 430/486; 430/448; 430/415

(58) Field of Classification Search ..... 430/449, 430/455, 459, 486, 448, 415
See application file for complete search history.

(56) References Cited

U.S. PATENT DOCUMENTS 3,622,332 A * 11/1971 Kane ..... 430/449
4,447,522 A * 5/1984 Hirano et al. ..... 430/448
6,022,675 A * 2/2000 Fitterman et al. ..... 430/486

OTHER PUBLICATIONS

U.S. Appl. No. 11/091,609 (D-88390), filed herewith, titled *High Speed Reflective Radiographic Material*, by R.E. Dickerson et al.

U.S. Appl. No. 11/091,601 (D-88389) filed herewith, titled *Reflective Radiographic Material with Incorporated Developer*, by R.E. Dickerson et al.

* cited by examiner

*Primary Examiner*—Geraldine Letscher
(74) *Attorney, Agent, or Firm*—J. Lanny Tucker

(57) ABSTRACT

Photographic silver halide materials containing an incorporated black-and-white developing agent can be quickly and simply processed using unique processing compositions and methods. In a "two-step" method, the exposed material is contacted with an alkaline activator solution followed by a fixing composition. In a "one-step" method, activation and fixing are combined using a single alkaline activator-fixing composition containing the fixing agent. None of the processing solutions include black-and-white developing agents. The photographic silver halide materials are preferably radiographic silver halide materials that have a reflective support and provide black-and-white images that can be viewed without a light box.

25 Claims, No Drawings

METHOD OF PROCESSING SILVER HALIDE MATERIALS

FIELD OF THE INVENTION

This invention relates in general to photography and in particular to various processing compositions and their use to provide black-and-white images in silver halide materials containing incorporated black-and-white developing agents. It also relates to processing kits comprising various processing compositions. In particular, the invention relates to processing of radiographic silver halide materials.

BACKGROUND OF THE INVENTION

In conventional medical diagnostic imaging, the object is to obtain an image of a patient's internal anatomy with as little X-radiation exposure as possible. The fastest imaging speeds are realized by mounting a duplitized radiographic silver halide material between a pair of fluorescent intensifying screens for imagewise exposure. About 5% or less of the exposing X-radiation passing through the patient is adsorbed directly by the latent image forming silver halide emulsion layers within the duplitized material. Most of the X-radiation that participates in image formation is absorbed by phosphor particles within the fluorescent screens. This stimulates light emission that is more readily absorbed by the silver halide emulsion layers.

Examples of radiographic silver halide materials that are useful for medical diagnostic purposes are described in U.S. Pat. No. 4,425,425 (Abbott et al.), U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and U.S. Pat. No. 5,576,156 (Dickerson), and *Research Disclosure*, Vol. 184, August 1979, Item 18431.

These radiographic materials are typically processed after exposure to provide a black-and-white image using developing and fixing compositions that are known in the art.

Development is usually the first step to providing a useful black-and-white image in radiographic silver halide materials. Photographic black-and-white developing compositions containing a silver halide black-and-white developing agent are well known in the photographic art for reducing silver ions in silver halide grains containing a latent image to yield a developed black-and-white photographic image. Many useful developing agents are known in the art, with hydroquinone and similar dihydroxybenzene compounds and ascorbic acid (and derivatives) being some of the most common. Such compositions generally contain other components such as sulfites, buffers, antifoggants, sequestering agents, halides and hardeners.

The development step is generally followed by a fixing step in which a photographic fixing agent is used to remove silver from non-imaged areas of the radiographic material. Various inorganic and organic fixing agents are known for this purpose. In most instances, development and fixing are distinct steps are described in U.S. Pat. No. 6,040,121 (Fitterman et al.), but in some instances, development and fixing are combined as described in U.S. Pat. No. 6,074,806 (Fitterman et al.).

Problem to be Solved

The radiographic silver halide described and used in the art traditionally contain various silver halide emulsion layers coated on a transparent film support (often coated on both sides) so the resulting images can be viewed using light boxes. However, in many remote parts of the world, light boxes are not available, thereby severely limiting the usefulness of traditional radiographic materials. In addition, in many parts of the world, there is insufficient electrical power to generate X-radiation using traditional high-power imaging machines, or such machines are too heavy for convenient transport to remote sites.

There is a need to find a means to provide meaningful radiographic imaging and diagnostics without the need for a light box. It would be useful if there were radiographic silver halide materials that could be processed in a simple fashion with low-power X-radiation equipment to provide images viewable under ambient lighting. While reflective radiographic silver halide materials were developed to solve this problem as described in copending and commonly assigned U.S. Ser. No. 11/091,609 (filed on even date herewith by Dickerson, Duke, Bunch, and Fitterman and entitled "High Speed Reflective Radiographic Material") and U.S. Ser. No. 11/091,601 (filed on even date herewith by Dickerson, Duke, and Fitterman and entitled "Reflective Radiographic Material with Incorporated Developer"), there was an additional need for simple and effective processing compositions and methods to use with these reflective radiographic silver halide materials.

SUMMARY OF THE INVENTION

The present invention provides a method of providing a black-and-white image comprising:

A) contacting an exposed radiographic silver halide material containing an incorporated black-and-white developing agent with an activator composition having a pH of at least 10 and at least 0.05 mol/l of sulfite ions, and B) contacting the exposed radiographic silver halide material with a solution comprising a fixing agent other than a sulfite, the solution being free of black-and-white developing agents, wherein steps A and B can be carried out sequentially or simultaneously when the activator composition also comprises the fixing agent.

This invention also provides a processing kit comprising:

a. an activator composition comprising at least 0.05 mol/l of sulfite ions and having a pH of at least 10, and b. a fixing composition comprising a fixing agent other than a sulfite, the fixing composition being free of black-and-white developing agents.

In other embodiments, the invention comprises an activator-fixing composition that, in aqueous form, has a pH of at least 10, and comprises at least 0.05 mol/l of sulfite ions and at least 0.05 mol/l of a fixing agent other than a sulfite, and is free of black-and-white developing agents.

Still further, a radiographic kit comprises:

a. an activator composition comprising at least 0.05 mol/l of sulfite ions and having a pH of at least 10, b. a fixing composition comprising a fixing agent other than a sulfite, the fixing composition being free of black-and-white developing agents, c. a radiographic silver halide material comprising a support that has first and second major surfaces, the radiographic material having disposed on at least one support major surface, one or more hydrophilic colloid layers including a silver halide emulsion layer, the radiographic material also containing an incorporated black-and-white developing agent in one or more of the hydrophilic colloid layers, and d. a phosphor screen.

Also, the present invention comprises a radiographic kit comprising:

a. an activator-fixing composition that, in aqueous form, has a pH of at least 10, and comprises at least 0.05 mol/l of sulfite ions and a fixing agent other than a sulfite, and is free of black-and-white developing agents, b. a radiographic silver halide material comprising a support that has first and second major surfaces, the radiographic material having disposed on at least one support major surface, one or more hydrophilic colloid layers including a silver halide emulsion layer, the radiographic material also containing an incorporated black-and-white developing agent in one or more of the hydrophilic colloid layers, and c. a phosphor screen.

We have found a method of processing silver halide materials that is simple, quick, and effective to provide black-and-white images. In particular, the method of processing can be used to provide radiographic images that can be viewed without a light box. More particularly, reflective radiographic silver halide materials containing incorporated black-and-white developing agents are processed using this invention.

In some embodiments, processing is carried out in two steps using an alkaline activator composition that "activates" the incorporated black-and-white developing agents, followed by a fixing step using an organic photographic fixing agent. In preferred embodiments, the activation and fixing reactions are carried out in combination by using a combined alkaline activator-fixing composition in a single processing step. Black-and-white developing agents are not present in the compositions containing the fixing agent to any appreciable extent because such compounds are incorporated within the processed materials.

It is also possible to reduce the impact of disposing of processing composition on the environment if certain biodegradable components, such as cysteine and other organic fixing agents, are used.

DETAILED DESCRIPTION OF THE INVENTION

Definitions

Unless otherwise noted, as used herein, the terms "incorporated developer" and "incorporated black-and-white developing agent" refer to the same chemical composition.

In the processing method of this invention, the "two-step" embodiments refer to the use of sequential activation and fixing steps, and the "one-step" embodiments refer to the use of a single activation-fixing step where activator and fixing occur simultaneously using an "activator-fixing" composition. By using these terms, however, we do not imply that the methods of this invention must include only activation and fixing, or activation-fixing steps.

The term "contrast" as herein employed refers to the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2-\log_{10}E_1$), $E_1$ and $E_2$ being the exposure levels at the reference points (1) and (2).

"Gamma" is used to refer to the instantaneous rate of change of a density vs. logE (exposure) sensitometric curve (or instantaneous contrast at any logE value).

The term "dynamic range" refers to the difference between $D_{max}$ and $D_{min}$ values on the Density vs. loge sensitometric curve at a specified exposure time. In the case of the data presented below in the Examples, the specified exposure time was 1/50 of a second.

In referring to grains and silver halide emulsions containing two or more halides, the halides are named in order of ascending molar concentrations.

The term "equivalent circular diameter" (ECD) is used to define the diameter of a circle having the same projected area as a silver halide grain. This can be measured using known techniques.

The term "aspect ratio" is used to define the ratio of grain ECD to grain thickness.

The term "coefficient of variation" (COV) is defined as 100 times the standard deviation (a) of grain ECD divided by the mean grain ECD.

The term "phosphor screen" refers to a fluorescent intensifying screens that absorbs X-radiation and promptly emits light immediately upon exposure to radiation while a "storage" screen or panel can "store" the exposing X-radiation for emission at a later time when the screen is irradiated with other radiation (usually visible light).

The terms "front" and "back" refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. The publication is also available from Emsworth Design Inc., 147 West 24th Street, New York, N.Y. 10011.

Processing Compositions and Methods

The present invention is useful for providing black-and-white images in any black-and-white photographic silver halide material containing an incorporated black-and-white developing agent (described below). Such photographic silver halide materials include, but are not limited to, radiographic films, aerial films, black-and-white motion picture films, duplicating and copy films, graphic arts films, positive- and negative-working microfilms, and amateur and professional continuous tone black-and-white films. The general compositions of such materials are well known in the art. This invention is particularly useful for providing black-and-white images in reflective radiographic silver halide materials described in more detail below.

The activator solution generally has a pH of at least 10, preferably at least 11, and more preferably at least 12. The alkalinity of this solution and the presence of sulfite ions "activates" the incorporated developer in the processed material. Alkalinity can be assured by addition of suitable amounts of one or more bases to the solution. Particularly useful bases are hydroxides such as sodium hydroxide and potassium hydroxide.

The activator solution generally also contains one or more sulfites. A "sulfite" is used herein to mean any sulfur compound that is capable of forming or providing sulfite ions in aqueous alkaline solution. Examples include, but are not limited to, alkali metal sulfites, alkali metal bisulfites, alkali metal metabisulfites, amine sulfur dioxide complexes, sulfurous acid and carbonyl-bisulfite adducts. Mixtures of these materials can also be used.

Examples of preferred sulfites include sodium sulfite, potassium sulfite, lithium sulfite, sodium bisulfite, potassium bisulfite, sodium metabisulfite, potassium metabisulfite, and lithium metabisulfite. The carbonyl-bisulfite adducts that are useful include alkali metal or amine bisulfite adducts of aldehydes and bisulfite adducts of ketones. Examples of these compounds include sodium formaldehyde bisulfite, sodium acetaldehyde bisulfite, succinaldehyde bis-sodium bisulfite, sodium acetone bisulfite, β-methyl glutaraldehyde bis-sodium bisulfite, sodium butanone bisulfite, and 2,4-pentandione bis-sodium bisulfite.

One or more sulfites are present in the activator solution in an amount sufficient to provide at least 0.05 mol/l of sulfite ions, and preferably from about 0.08 to about 0.2 mol/l of sulfite ions. Various sulfites are readily available from a number of commercial sources.

The activator solution can also contain one or more sequestering agents that typically function to form stable complexes with free metal ions or trace impurities (such as silver, calcium, iron and copper ions) in solution that may be introduced into the developing composition in a number of ways. The sequestering agents, individually or in admixture, are present in conventional amounts. Many useful sequestering agents are known in the art, but particularly useful classes of compounds include, but are not limited to, multimeric carboxylic acids, polyphosphonic acids and polyaminophosphonic acids, and any combinations of these classes of materials as described in U.S. Pat. No. 5,389,502 (Fitterman et al.), aminopolycarboxylic acids and polyphosphate ligands. Representative sequestering agents include ethylenediaminetetraacetic acid ("EDTA"), diethylenetriaminepentaacetic acid ("DTPA"), 1,3-propylenediaminetetraacetic acid ("PDTA"), 1,3-diamino-2-propanoltetraacetic acid ("DPTA"), ethylenediaminodisuccinic acid ("EDDS"), ethylenediaminomonosuccinic acid ("EDMS"), 4,5-dihydroxy-1,3-benzenedisulfonic acid, disodium salt (TIRON™), N,N'-1,2-ethanediylbis{N-[(2-hydroxyphenyl)methyl]}glycine ("HBED"), N-{2-[bis(carboxymethyl)-amino]ethyl}-N-(2-hydroxyethyl)glycine ("HEDTA"), N-{2-[bis(carboxymethyl)-amino]ethyl}-N-(2-hydroxyethyl)glycine, trisodium salt (available as VERSENOL™ from Acros Organics, Sigma Chemical or Callaway Chemical), and 1-hydroxyethylidenediphosphonic acid (available as DEQUEST™2010 from Solutia Co.). These compounds can be used in free acid or salt form and are usually present in an amount of from about 0.002 to about 0.005 mol/l.

The activator solution can also contain other additives including various development restrainers, development accelerators, swelling control agents, dissolving aids, surface active agents, colloid dispersing aids, restrainers (such as sodium or potassium bromide), and sludge control agents (such as 2-mercaptobenzothiazole, 1,2,4-triazole-3-thiol, 2-benzoxazolethiol and 1-phenyl-5-mercatoetrazole), each in conventional amounts. Examples of such components are described in U.S. Pat. No. 5,236,816 (noted above), U.S. Pat. No. 5,474,879 (Fitterman et al.), and U.S. Pat. No. 5,837,434 (Roussilhe et al.), Japanese Kokai 7-56286, and EP 0 585 792A1.

A photographic fixing agent can be used in this invention either in a separate fixing composition as required by the "two-step" embodiments, or as a component of the "activator-fixing" composition used in the "one-step" embodiments.

While sulfites sometimes act as fixing agents, the photographic fixing agents used in this invention are compounds other than sulfites. These compounds include thiosulfates (including sodium thiosulfate, ammonium thiosulfate, potassium thiosulfate and others readily known in the art), thiol- or mercapto-containing compounds or disulfides (such as D-, L-, or D,L-cysteine, cysteine hydrochloride, homocysteine, methionine, cystine, thiourea, 2-aminoethanethiol, 2-aminoethanethiol hydrochloride, 3-aminopropanethiol, mercaptopyridine, and others described by Haist, *Modern Photographic Processing*, John Wiley & Sons, N.Y., Vol. I, 1979), mercapto acids (such as mercaptosuccinic acid, mercaptoacetic acid, thiosalicylic acid and others described in the noted Haist reference, pp. 602–605 and by Mason, *Photographic Processing Chemistry*, Chapter VI, p. 198) and thiocyanates (such as sodium thiocyanate, potassium thiocyanate, ammonium thiocyanate and others readily known in the art as described in the noted Haist reference, p. 596ff and Mason reference, p. 197). Mixtures of one or more of these classes of photographic fixing agents can be used if desired. By "thiol-containing", we mean a compound having an —SR group wherein R is hydrogen or methyl. Additional useful fixing agents are the sulfur-containing compounds defined by Structures I, II, III, and IV in U.S. Pat. No. 6,623,915 (Haye et al.), that is incorporated herein by reference for those sulfur-containing compounds.

Particularly useful fixing agents are one or more of cysteine, thiourea, mercaptopyridine, cysteine hydrochloride, 2-aminoethanethiol, 3-aminopropanethiol, cystine, methionine, thiosalicylic acid, and 2-amino-4-thiobutyric acid.

In some embodiments of this invention, the thiosulfates are preferred fixing agents, but in other embodiments (both in the "one-step" and "two-step" embodiments), the preferred fixing agents are one or more isomers of cysteine or salts thereof. When cysteine is used as the photographic fixing agent, less molar amounts may be used at shorter times than other fixing agents.

In the "two-step" embodiments, the one or more fixing agents can be present in the fixing composition in an amount of at least 0.2 mol/l, and preferably from about 0.3 to about 1.2 mol/l.

The fixing composition can also include bromide ion in an amount of from about 0.01 to about 0.02 mol/l.

The fixing compositions used in the "two-step" embodiments can also include one or more sequestering agents (as defined above), sulfites (as preservatives rather than as fixing agents), buffers, fixing accelerators, swelling control agents, and stabilizing agents, each in conventional amounts. In its aqueous form, the fixing composition generally has a pH of at least 4, preferably at least 4.5, and generally less than 6, and preferably less than 5.5.

As noted herein, concentrations are given in mol/l in reference to amounts within aqueous solutions. It is understood, however, that the fixing and "activator-fixing" compositions can be formulated in dry form (for example, powder or pellets) and then hydrated to form the aqueous processing solutions having the described component concentrations and pH.

The "activator-fixing" compositions used in the "one-step" embodiments that when in aqueous form, have a pH of at least 10 and preferably a pH of at least 11.

In the "activator-fixing" composition, the one or more fixing agents (other than sulfites) are generally present in an amount of at least 0.05 mol/l, and preferably from about 0.1 to about 0.25 mol/l. Sulfite ions are generally present in an amount of from about 0.05 to about 0.2 mol/l, bromide ions can be present in an amount of from about 0.01 to about 0.02 mol/l, and one or more sequestering agents can be present in an amount of from about 0.002 to about 0.005 mol/l.

The "one-step" embodiments of this invention are preferred wherein the activator-fixing composition includes cysteine or a salt thereof as the fixing agent.

As noted above, black-and-white developing agents are not present within the compositions containing the fixing agents. Such developing agents include such compounds as aminophenols, polyhydroxybenzenes (such as p-dihydroxybenezenes including hydroquinone and its derivatives), 3-pyrazolidinones, ascorbic acid and its derivatives, and phenylenediamines, and well as other compounds that would be readily apparent to one skilled in the art.

Processing can be carried out in any suitable processor or processing container for a given type of photographic material (for example, sheets, strips or rolls). The photographic material is generally bathed in the processing compositions for a suitable period of time. For example, in the "two-step" embodiments, activation is generally carried out for at least 30 and up to 120 seconds, and preferably for from about 30 to about 60 seconds. The fixing step is generally carried out for at least 30 and up to 120 seconds, and preferably for from about 60 to about 90 seconds. The temperatures for both steps can be within the range of from about 10 to about 40° C., and preferably from about 20 to about 30° C. When cysteine is used as the fixing agent, shorter fixing times (for example, from about 30 to about 60 seconds) may be possible.

In the "one-step" embodiments, simultaneous activation and fixing are carried out for at least 30 and up to 90 seconds, and preferably from about 30 to about 60 seconds. The processing temperature can be within the range of from about 10 to about 40° C., and preferably from about 20 to about 30° C.

The activation and fixing steps (or combined activation-fixing step) are preferably, but not essentially, followed by a suitable washing step to remove silver salts dissolved by fixing and excess fixing agents, and to reduce swelling in the element. The wash solution can be water, but preferably the wash solution is acidic, and more preferably, the pH is from 4.5 to 7, as provided by a suitable chemical acid or buffer. Washing can be carried out for any suitable length of time, but generally from about 30 to about 90 seconds is sufficient.

After washing, the processed materials may be dried using suitable times and temperatures, but in some instances the black-and-white images may be viewed in a wet condition.

Silver Halide Materials

The materials used in the practice of the present invention include any black-and-white silver halide materials comprising one or more silver halide emulsion layers and one or more "incorporated black-and-white developing agents" in one or more of those emulsion layers. Such black-and-white silver halide materials include commercial and consumer black-and-white films and papers, graphic arts films, black-and-white motion picture films, and especially radiographic materials.

Examples of black-and-white papers and films that can be processed using the present invention include, but are not limited to, KODAK TRI-X-PAN Black and White Film, KODAK PLUS X-PAN Black and White Film, KODAK TMAX 100 and 400 speed Black and White Films, KODAK POLYMAX II RC Black and White Papers, KODAK KODABROME II RC F Black and White Paper, KODAK PMAX Art RC V Black and White Paper, KODAK POLY-CONTRAST III RC Black and White Paper, KODAK PANALURE Select RC Black and White Paper, KODAK POLYMAX FINE ART Black and White Papers, KODAK AZO Black and White Papers, ILFORD MULTIGRADE IV RC and FB Black and White Papers, ILFORD ILFOBROME GALARIE Black and White Papers, and AGFA MULTICONTRAST CLASSIC, PREMIUM Black and White Papers.

In particular, the present invention is used to process radiographic materials comprising the incorporated black-and-white developing agents described herein. More particularly, the radiographic materials are "reflective radiographic materials" that have a speed of at least 200, preferably of at least 800, and more preferably of at least 1600, and include a reflective support (described below) having disposed on one side only, one or more photographic silver halide emulsion (hydrophilic colloid) layers and optionally one or more non-light sensitive hydrophilic colloid layer(s). Where there are multiple silver halide emulsion layers, their composition, thickness, and sensitometric properties can be the same or different. Preferably, there is a single silver halide emulsion layer on the reflective support.

In most preferred embodiments, the reflective radiographic materials have a single silver halide emulsion layer on one side of the reflective support and a protective overcoat (described below) over it and any other non-light sensitive layers. Thus, at least one non-light sensitive hydrophilic layer is included with the silver halide emulsion layer. This layer may be an interlayer or overcoat, or both types of non-light sensitive layers can be present.

The silver halide emulsion layer(s) can include silver halide grains having any desirable morphology or comprise a mixture of two or more of such morphologies as long as the desired photographic speed is achieved for the radiographic material. The composition and methods of making such silver halide grains are well known in the art.

Preferably, the one or more silver halide emulsion layers comprise predominantly (more than 50%, and preferably at least 70%, of the total grain projected area) tabular silver halide grains. The grain composition can vary among multiple silver halide emulsion layers, but preferably, the grain composition is essentially the same in all silver halide emulsion layers. These tabular silver halide grains generally comprise at least 50, preferably at least 90, and more preferably at least 95, mol % bromide, based on total silver in the particular emulsion layer. Such emulsions include silver halide grains composed of, for example, silver iodobromide, silver chlorobromide, silver iodochlorobromide, and silver chloroiodobromide. The iodide grain content is generally up to 5 mol %, based on total silver in the emulsion layer. Preferably the iodide grain content is up to 3 mol %, and more preferably up to about 1 mol % (based on total silver in the emulsion layer). Mixtures of different tabular silver halide grains can be used in the silver halide emulsion layers.

The tabular silver halide grains used in the silver halide emulsion layers generally have as aspect ratio of 25 or more, preferably of 30 or more and up to 45, and more preferably from about 30 to about 40. The aspect ratio can be the same or different in multiple silver halide emulsion layers, but preferably, the aspect ratio is essentially the same in all layers.

In general, the tabular grains have an average grain diameter (ECD) of at least 3.5 μm, and preferably of from about 4 to about 4.5 μm. The average grain diameters can be the same or different in multiple silver halide emulsion layers. At least 100 non-overlapping tabular grains are measured to obtain the "average" ECD.

In addition, the tabular grains generally have an average thickness of from about 0.07 to about 0.12 μm, preferably from about 0.09 to about 0.11 μm, and more preferably from about 0.10 to about 0.11 μm. The average thickness can be the same or different but preferably it is essentially the same for multiple silver halide emulsion layers.

The procedures and equipment used to determine tabular grain size (and aspect ratio) are well known in the art.

Tabular grain emulsions that have the desired composition and sizes are described in greater detail in the following patents, the disclosures of which are incorporated herein by reference in relation to the tabular grains:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

A variety of silver halide dopants can be used, individually and in combination, in one or more of the silver halide emulsion layers to improve contrast as well as other common sensitometric properties. A summary of conventional dopants is provided in *Research Disclosure*, Item 38957 [Section I Emulsion grains and their preparation, sub-section D, and grain modifying conditions and adjustments are in paragraphs (3), (4), and (5)].

A general summary of silver halide emulsions and their preparation is provided in *Research Disclosure*, Item 38957 (Section I Emulsion grains and their preparation). After precipitation and before chemical sensitization the emulsions can be washed by any convenient conventional technique using techniques disclosed by *Research Disclosure*, Item 38957 (Section III Emulsion washing).

Any of the emulsions can be chemically sensitized by any convenient conventional technique as illustrated by *Research Disclosure*, Item 38957 (Section IV Chemical Sensitization). Sulfur, selenium or gold sensitization (or any combination thereof) is specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

In addition, if desired, any of the silver halide emulsions can include one or more suitable spectral sensitizing dyes that include, for example, cyanine and merocyanine spectral sensitizing dyes. The useful amounts of such dyes are well known in the art but are generally within the range of from about 200 to about 1000 mg/mole of silver in the given emulsion layer. It is preferred that all of the silver halide grains used in the present invention (in all silver halide emulsion layers) be "green-sensitized" (spectrally sensitized to radiation of from about 470 to about 570 nm of the electromagnetic spectrum) or "blue-sensitized" (spectrally sensitized to radiation of from about 400 to about 530 nm). Various spectral sensitizing dyes are known for achieving this property.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated in *Research Disclosure*, Item 38957 (Section VII Antifoggants and stabilizers) and Item 18431 (Section II Emulsion Stabilizers, Antifoggants and Antikinking Agents).

It may also be desirable that the silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds are described in U.S. Pat. No. 5,800,976 (Dickerson et al.) that is incorporated herein by reference for the teaching of such sulfur-containing covering power enhancing compounds.

The silver halide emulsion layers and other hydrophilic layers on the reflective support of the radiographic materials generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957 (Section II Vehicles, vehicle extenders, vehicle-like addenda and vehicle related addenda). The emulsions themselves can contain peptizers of the type set out in Section II, paragraph A (Gelatin and hydrophilic colloid peptizers). The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes, polyacrylamides (including polymethacrylamides), and dextrans as described in U.S. Pat. No. 5,876,913 (Dickerson et al.), incorporated herein by reference.

Thin, high aspect ratio tabular grain silver halide emulsions will typically be prepared by processes including nucleation and subsequent growth steps. During nucleation, silver and halide salt solutions are combined to precipitate a population of silver halide nuclei in a reaction vessel. Double jet (addition of silver and halide salt solutions simultaneously) and single jet (addition of one salt solution, such as a silver salt solution, to a vessel already containing an excess of the other salt) process are known. During the subsequent growth step, silver and halide salt solutions, and/or preformed fine silver halide grains, are added to the nuclei in the reaction vessel, and the added silver and halide combines with the existing population of grain nuclei to form larger grains. Control of conditions for formation of high aspect ratio tabular grain silver bromide and iodobromide emulsions is known, for example, based upon U.S. Pat. No. 4,434,226 (Wilgus et al.), U.S. Pat. No. 4,433,048 (Solberg et al.), and U.S. Pat. No. 4,439,520 (Kofron et al.). It is recognized, for example, that the bromide ion concentration in solution at the stage of grain formation must be maintained within limits to achieve the desired tabularity of grains. As grain growth continues, the bromide ion concentration in solution becomes progressively less influential on the grain shape ultimately achieved. For example, U.S. Pat. No. 4,434,226 (Wilgus et al.), for example, teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. U.S. Pat. No. 4,439,520 (Kofron et al.) extends these teachings to the precipitation of high aspect ratio tabular grain silver bromide emulsions. pBr is defined as the negative log of the solution bromide ion concentration. U.S. Pat. No. 4,414,310 (Daubendiek et al.) describes a process for the preparation of high aspect ratio silver bromoiodide emulsions under pBr conditions not exceeding the value of 1.64 during grain nucleation. U.S. Pat. No. 4,713,320 (Maskasky), in the preparation of high aspect ratio silver halide emulsions, teaches that the useful pBr range during nucleation can be extended to a value of 2.4 when the precipitation of the tabular silver bromide or bromoiodide grains occurs in the presence of gelatino-peptizer containing less than 30 micromoles of methionine (for example, oxidized gelatin) per gram. The use of such oxidized gel also enables the preparation of thinner and/or larger diameter grains, and/or more uniform grain populations containing fewer non-tabular grains.

The use of oxidized gelatin as peptizer during nucleation, such as taught by U.S. Pat. No. 4,713,320 (noted above), is particularly preferred for making thin, high aspect ratio tabular grain emulsions, employing either double or single jet nucleation processes. As gelatin employed as peptizer during nucleation typically will comprise only a fraction of the total gelatin employed in an emulsion, the percentage of oxidized gelatin in the resulting emulsion may be relatively small, that is, at least 0.05% (based on total dry weight).

Thus it is preferred that the coated tabular grain silver halide emulsion layers comprise tabular silver halide grains dispersed in a hydrophilic polymeric vehicle mixture comprising at least 0.05% and preferably at least 0.1% of oxidized gelatin based on the total dry weight of hydrophilic polymeric vehicle mixture in the coated emulsion layer. The upper limit for the oxidized gelatin is not critical but for practical purposes, it is 1.5% based on the total dry weight of the hydrophilic polymer vehicle mixture. Preferably, from about 0.1 to about 1.5% (by dry weight) of the hydrophilic polymer vehicle mixture is oxidized gelatin.

It is also preferred that the oxidized gelatin be in the form of deionized oxidized gelatin but non-deionized oxidized gelatin can be used, or a mixture of deionized and non-deionized oxidized gelatins can be used. Deionized or non-deionized oxidized gelatin generally has the property of relatively lower amounts of methionine per gram of gelatin than other forms of gelatin. Preferably, the amount of methionine is from 0 to about 3 μmol of methionine, and more preferably from 0 to 1 μmol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the reflective radiographic materials are generally fully hardened using one or more conventional hardeners. Thus, the amount of hardener on the one side of the support is generally at least 1% and preferably at least 1.5%, based on the total dry weight of the polymer vehicles.

The levels of silver and polymer vehicle in the reflective radiographic material can vary in the various silver halide emulsion layers. In general, the total amount of silver on the imaging side of the reflective support is at least 13 and no more than 18 mg/dm$^2$ (preferably from about 15 to about 18 mg/dm$^2$). In addition, the total coverage of polymer vehicle (all layers) on the imaging side of the reflective support is generally at least 36 and no more than 40 mg/dm$^2$ (preferably from about 38 to about 40 mg/dm$^2$). These amounts refer to dry weights.

The reflective radiographic materials generally include a surface protective overcoat disposed on the imaging side that typically provides for physical protection of the various layers underneath. The protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are described in *Research Disclosure*, Item 38957 (Section IX Coating physical property modifying addenda, A. Coating aids, B. Plasticizers and lubricants, C. Antistats, and D. Matting agents). Interlayers that are typically thin hydrophilic colloid layers can be used to provide a separation between the silver halide emulsion layers and the surface overcoats or between the silver halide emulsion layers. The overcoat can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers.

The various coated layers of radiographic materials can also contain tinting dyes to modify the image tone to reflected light. These dyes are not decolorized during processing and may be homogeneously or heterogeneously dispersed in the various layers. Preferably, such non-bleachable tinting dyes are in one or more silver halide emulsion layers.

In some embodiments, the reflective radiographic materials contain one or more "incorporated black-and-white developing agents" (or reducing agents) that are compounds that can act to reduce silver (I) ion to silver metal. Conventional black-and-white developing agents of this type include aminophenols, polyhydroxybenzenes (such asp-dihydroxybenezenes including hydroquinone and its derivatives), ascorbic acid and its derivatives (see for example U.S. Pat. No. 5,236,816 of Purol et al. and U.S. Pat. No. 5,738,979 of Fitterman et al., both incorporated by reference), 3-pyrazolidinones, and phenylenediamines. Hydroquinone and its derivatives are preferred black-and-white developing agents. Mixtures of black-and-white developing agents can be used if desired.

The quantity of black-and-white developing agent in the reflective radiographic material depends upon the silver content of silver halide emulsion layer in which it is located and the reducing agent "strength" of the developing agent. It can be located in the single silver halide emulsion layer, or in one or more of multiple silver halide emulsion layers. Generally, the molar ratio of developer to silver is at least 0.25:1 and preferably it is from about 0.5:1 to about 2:1.

It may also be useful to include one or more "co-developers" in one or more silver halide emulsion layers that may work in association with the black-and-white developing agent to enhance the development process. The co-developer is usually present in a smaller quantity than the black-and-white developing agent with a molar ratio of black-and-white developing agent to co-developer being from about 10:1 to about 300:1, and preferably from about 175:1 to about 250:1.

Useful co-developers include aminophenols [such as p-aminophenol, o-aminophenol, N-methylaminophenyl, 2,4-diaminophenol hydrochloride, N-(4-hydroxyphenyl) glycine, and ELON® (methyl-p-aminophenol sulfate)], 1-phenyl-3-pyrazolidones or phenidones [such as compounds described in U.S. Pat. No. 5,236,816 (noted above) including phenidone-A (1-phenyl-3-pyrazolidone), phenidone-B (1-phenyl-4,4'-dimethyl-3-pyrazolidone), dimezone-S (1-phenyl-4-methyl-4'-hydroxymethyl-3-pyrazolidone)], blocked phenidones, and many other compounds known in the art. A most preferred co-developer is 1-phenyl-4-methyl-4'-hydroxymethyl-3-pyrazolidone.

The black-and-white developing agents and co-developers can be incorporated into the silver halide layer(s) or into an adjacent non-photosensitive layer using procedures known in the art.

The reflective radiographic materials have a reflective support. By "reflective", we mean a support having a composition or structural arrangement such that it reflects at least 70% of incident light (such as light emitted from a fluorescent intensifying screen). Preferably, at least 80% of incident light is reflected by the support.

Various reflective supports can be used including those used for conventional photographic papers that comprise wood fibers or a cellulosic material that is generally coated with baryta or one or more resins or polymers (such as polyolefins). Either or both the coating or paper can contain various reflective pigments such as titanium dioxide, barium sulfate, zinc sulfate, and others known in the photographic color paper art, antioxidants, optical brighteners and fluorescent materials. Further details about reflective paper supports are provided in *Research Disclosure*, September 1996, Item 38957, paragraph XV and references cited therein.

Reflective lenticular supports as described in U.S. Pat. No. 5,013,621 (Kistner et al.) and U.S. Pat. No. 5,075,204 (Shiba et al.) can also be used.

Pigmented polymer supports can also be used including pigmented polyesters, pigmented polystyrene, and pigmented polycarbonates.

In addition, a reflective support can be a single- or multi-layer reflective sheet that is a reflective substrate comprising a "microvoided" continuous polyester first phase and a second phase dispersed within the continuous polyester first phase. This second phase comprises microvoids containing barium sulfate particles.

The continuous polyester first phase of the reflective substrate provides a matrix for the other components of the reflective substrate and is transparent to longer wavelength electromagnetic radiation. This polyester phase can comprise a film or sheet of one or more thermoplastic polyesters, which film has been biaxially stretched (that is, stretched in both the longitudinal and transverse directions) to create the microvoids therein around the barium sulfate particles. Any suitable polyester can be used as long as it can be cast, spun, molded, or otherwise formed into a film or sheet, and can be biaxially oriented as noted above. Generally, the polyesters have a glass transition temperature of from about 50 to about 150° C. (preferably from about 60 to about 100° C.) as determined using a differential scanning calorimeter (DSC). Suitable polyesters include those produced from the reaction of aromatic, aliphatic, or carbocyclic dicarboxylic acids of 4 to 20 carbon atoms and aliphatic or aromatic glycols having 2 to 24 carbon atoms.

Suitable polyesters that can be used in the practice of this invention include, but are not limited to, poly(1,4-cyclohexylene dimethylene terephthalate), poly(ethylene terephthalate), poly(ethylene naphthalate), and poly(1,3-cyclohexylene dimethylene terephthalate). Poly(1,4-cyclohexylene dimethylene terephthalate) is most preferred.

The ratio of the refractive index of the continuous polyester first phase to the second phase is from about 1.4:1 to about 1.6:1.

Barium sulfate particles are incorporated into the continuous polyester phase. These particles generally have an average particle size of from about 0.3 to about 2 μm (preferably from about 0.7 to about 1.0 μm). In addition, these particles comprise from about 35 to about 65 weight % (preferably from about 55 to about 60 weight %) of the total dry reflective substrate weight, and from about 15 to about 25% of the total reflective substrate volume.

The barium sulfate particles can be incorporated into the continuous polyester phase by various means. For example, they can be incorporated during polymerization of the dicarboxylic acid(s) and polyol(s) used to make the continuous polyester first phase. Alternatively and preferably, the barium sulfate particles are mixed into pellets of the polyester and the mixture is extruded to produce a melt stream that is cooled into the desired sheet containing barium sulfate particles dispersed therein.

These barium sulfate particles are at least partially bordered by voids because they are embedded in the microvoids distributed throughout the continuous polyester first phase. Thus, the microvoids containing the barium sulfate particles comprise a second phase dispersed within the continuous polyester first phase. The microvoids generally occupy from about 35 to about 60% (by volume) of the dry reflective substrate.

The microvoids can be of any particular shape, that is circular, elliptical, convex, or any other shape reflecting the film orientation process and the shape and size of the barium sulfate particles. The size and ultimate physical properties of the microvoids depend upon the degree and balance of the orientation, temperature and rate of stretching, crystallization characteristics of the polyester, the size and distribution of the barium sulfate particles, and other considerations that would be apparent to one skilled in the art. Generally, the microvoids are formed when the extruded sheet containing barium sulfate particles is biaxially stretched using conventional orientation techniques.

Further details about such "microvoided" supports are provided in copending and commonly assigned U.S. Ser. No. 10/968,483 (filed Oct. 19, 2004 by Laney and Steklenski).

Still other reflective supports can be similarly prepared using a "microvoided" poly(lactic acid) instead of a "microvoided" polyester as described in U.S. Pat. No. 6,836,606 (Laney et al.).

The reflective support can have a thickness (dry) of from about 150 to about 190 μm (preferably from about 170 to about 190 μm).

Phosphor Screens

A reflective radiographic material and a phosphor screen can be arranged in a suitable "cassette" designed for this purpose. Fluorescent intensifying screens are typically designed to absorb X-rays and to promptly emit electromagnetic radiation having a wavelength greater than 300 nm. These screens can take any convenient form providing they meet all of the usual requirements for use in radiographic imaging. Examples of conventional, useful fluorescent intensifying screens and methods of making them are provided in *Research Disclosure*, Item 18431 (Section IX X-Ray Screens/Phosphors) and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains prompt-emitting phosphor particles dispersed in a suitable binder, and may also include a light scattering material, such as titania.

Any prompt-emitting phosphor can be used, singly or in mixtures, in the intensifying screens. The phosphors can be either blue-light or green-light emitting phosphors. For example, useful phosphors are described in numerous references relating to fluorescent intensifying screens, including but not limited to, *Research Disclosure*, Vol. 184, August 1979, Item 18431 (Section IX X-ray Screens/Phosphors) and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 4,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), and U.S. Pat. No. 5,871,892 (Dickerson et al.), and EP 0 491,116A1 (Benzo et al.), the disclosures of all of which are incorporated herein by reference with respect to the phosphors.

The inorganic phosphor can be calcium tungstate, activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Alternatively, the inorganic phosphor is a rare earth oxychalcogenide and oxyhalide phosphors and represented by the following formula (1):

$$M'_{(w-n)}M''_{n}O_{w}X' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Th), thulium (Tm), or ytterbium (Yb), X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides or oxysulfides (such as $Gd_2O_2S$:Tb).

Other suitable phosphors are described in U.S. Pat. No. 4,835,397 (Arakawa et al.) and U.S. Pat. No. 5,381,015 (Dooms), both incorporated herein by reference, and include for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting phosphors such as barium fluorobromide.

Another class of useful phosphors includes rare earth hosts such as rare earth activated mixed alkaline earth metal sulfates such as europium-activated barium strontium sulfate.

Other useful phosphors are alkaline earth metal phosphors that can be the products of firing starting materials comprising optional oxide or a combination of species as characterized by the following formula (2):

$$MFX_{1-z}I_{z}uM^{a}X^{a}:yA:eQ:tD \quad (2)$$

wherein "M" is magnesium (Mg), calcium (Ca), strontium (Sr), or barium (Ba), "F" is fluoride, "X" is chloride (Cl) or bromide (Br), "I" is iodide, Ma is sodium (Na), potassium (K), rubidium (Rb), or cesium (Cs), Xa is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni). The numbers in the noted formula are the following: "z" is 0 to 1, "u" is from 0 to 1, "y" is from $1\times10^{-4}$ to 0.1, "e" is form 0 to 1, and "t" is from 0 to 0.01. These definitions apply wherever they are found in this application unless specifically stated to the contrary. It is also contemplated that "M", "X", "A", and "D" represent multiple elements in the groups identified above.

The phosphor can be dispersed in a suitable binder(s) in a phosphor layer. A particularly useful binder is a polyurethane binder such as that commercially available under the trademark Permuthane.

The fluorescent intensifying screens useful in this invention exhibit a photographic "screen" speed of at least 100 and preferably of at least 400. One preferred green-light emitting phosphor is a terbium activated gadolinium oxysulfide. Preferred blue-light emitting phosphors include calcium tungstate and barium fluorobromide. A skilled worker in the art would be able to choose the appropriate inorganic phosphor, its particle size, emission wavelength, and coverage in the phosphor layer to provide the desired screen speed.

Support materials for fluorescent intensifying screens include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate, metal sheets such as aluminum foil and aluminum alloy foil, ordinary papers, baryta paper, resin-coated papers, pigmented papers containing titanium dioxide or the like, and papers sized with polyvinyl alcohol or the like. A flexible plastic film is preferably used as the support material.

In addition, the support can be a "microvoided support" as described in more detail in U.S. Pat. No. 6,836,606 and U.S. Ser. No. 10/968,483 noted above.

The plastic film may contain a light-absorbing material such as carbon black, or may contain a light-reflecting material such as titanium dioxide or barium sulfate. The former is appropriate for preparing a high-resolution type radiographic screen, while the latter is appropriate for preparing a high-sensitivity screen. It is highly preferred that the support absorbs substantially all of the radiation emitted by the phosphor. Examples of preferred supports include polyethylene terephthalate, blue colored or black colored (for example, LUMIRROR C, type X30 supplied by Toray Industries, Tokyo, Japan). These supports may have a thickness that may differ depending o the material of the support, and may generally be between 60 and 1000 μm, more preferably between 80 and 500 μm from the standpoint of handling.

Imaging Conditions

The exposure of black-and-white materials (including radiographic materials) can be undertaken in any convenient manner. The exposure techniques of U.S. Pat. No. 5,021,327 (Bunch et al.) and U.S. Pat. No. 5,576,156 (Dickerson) are typical for radiographic materials. In operation, a radiographic material is generally included in an imaging assembly that also includes one or more fluorescent intensifying screens in front or back of the radiographic material. The radiographic material and front and back screens are usually mounted in direct contact in a suitable cassette. X-radiation in an imagewise pattern is passed through and partially absorbed in the front intensifying screen, and a portion of the absorbed X-radiation is re-emitted as a visible light image that exposes the silver halide emulsion units of the radiographic material. For the reflective radiographic silver halide materials described above, only a single "frontside" screen is used for imaging.

It is advantageous that an imaging assembly comprising the reflective radiographic material and a screen has sufficiently high photographic speed that they can be imaged using "low power" and less expensive X-radiation generators. Generally, such X-radiation generators have relatively low, fixed X-radiation tube currents in the range of from about 15 to about 20 milliAmperes (mA) and peak 100–130 kVp voltage, preferably also used combination with an anti-X-ray scatter grid with a grid ratio of 8:1 or higher. In contrast, the typical "fixed installation" high-powered X-radiation generating systems produce 500–1000 mA enabling very short (5–40 milliseconds) patient exposure times for motion-sensitive imaging such as chest radiography.

Radiographic Kits

The processing compositions described and used for this invention can be suitably packaged in individual bottles, packets, syringes, or other containers known in the art and sold together in a "kit" along with instructions for use and/or measuring devices. Radiographic kits can also include one or more radiographic films containing incorporated developers including the reflective radiographic materials described herein, and/or phosphor screens.

The following examples are provided to illustrate the practice of the invention but the invention is not to be interpreted as limited by the examples.

EXAMPLE 1

Two-Step Processing Methods

A two-step processing method of this invention was carried out using the following processing solutions:

| | | |
|---|---|---|
| Activator Solution: | | |
| Potassium bromide | 0.017 | mol/l |
| Potassium hydroxide | 1.75 | mol/l |
| Ethylenediaminetetraacetic acid (EDTA) | 1 | g/l |
| Sodium sulfite | 0.156 | mol/l |
| pH | >12 | |
| Fixing Composition 1: | | |
| Ammonium thiosulfate | 1.0 | mol/l |
| Sodium thiosulfate | 0.15 | mol/l |
| Pentetic acid, pentasodium salt | 2 | g/l |
| Sodium sulfite | 0.15 | mol/l |
| Acetic acid | 0.08 | mol/l |
| pH | 4.2 | |
| Fixing Composition 2: | | |
| Cysteine hydrochloride | 0.3 | mol/l |
| Sodium hydroxide | 0.25 | mol/l |
| Sodium sulfite | 0.05 | mol/l |
| Acetic acid | 0.05 | mol/l |
| pH | 6.0 | |

A Control two-step method was carried out using the following black-and-white developing and fixing compositions:

| | | |
|---|---|---|
| Hydroquinone | 30 | g |
| Phenidone | 1.5 | g |
| Potassium hydroxide | 21 | g |
| $NaHCO_3$ | 7.5 | g |
| $K_2SO_3$ | 44.2 | g |
| $Na_2S_2O_5$ | 12.6 | g |
| Sodium bromide | 35 | g |
| 5-Methylbenzotriazole | 0.06 | g |
| Glutaraldehyde | 4.9 | g |
| Water to 1 liter, pH 10 | | |

Fixing was carried out using KODAK RP X-OMAT® LO Fixer and Replenisher fixing composition (Eastman Kodak Company).

Samples of the following reflective radiographic materials were exposed and processed:

Radiographic Material A (Invention):

Radiographic Material A was a reflective radiographic material with a single green-light sensitive silver halide emulsion layer disposed on one side only of a reflective support. The emulsion layer contained tabular silver halide grains that were prepared and dispersed in deionized oxidized gelatin that had been added at multiple times before and/or during the nucleation and early growth of the silver bromide tabular grains dispersed therein. The tabular grains had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with sulfur, gold, and selenium using conventional procedures. Spectral sensitization to about 560 nm was provided using anhydro-5,5-dichloro-9-ethyl-3,3'-bis(3-sulfopropyl)oxacarbocyanine hydroxide (680 mg/mole of silver) followed by potassium iodide (400 mg/mole of silver).

The reflective support was a resin-coated paper support containing a reflective pigment having the desired reflectance for this invention.

Material A had the following layer arrangement and formulations on the reflective support:

Overcoat

Emulsion Layer

Reflective Support

| | Coverage (mg/dm$^2$) |
|---|---|
| Overcoat Formulation | |
| Gelatin vehicle | 10.8 |
| TRITON ® X-200E surfactant | 0.28 |
| Olin 10G surfactant | 0.74 |
| Emulsion Layer Formulation | |
| Tabular grain emulsion [AgBr 4.0 μm ave. dia. × 0.10 μm thickness] | 16.1 |
| Oxidized gelatin vehicle | 2.5 |
| Non-oxidized gelatin vehicle | 22.8 |
| 5-Bromo-4-hydroxy-6-methyl-1,3,3a,7-tetraazaindene | 0.03 |
| Hydroquinone | 11.7 |
| 4-methyl-4'-hydroxymethyl-1-phenyl pyrazolidone | 0.1 |
| 2-Propenoic acid, butyl ester, polymer derived from ethenylbenzene, 2-methyl-2-((1-oxo-2-propenyl)amino)-1-propane-sulfonic acid, monosodium salt and 2-methyl-2-propenamide | 10.0 |
| TRITON ® X-200E surfactant | 0.3 |
| Oxiranemethanol, polymer with nonylphenol | 0.9 |
| Bisvinylsulfonylmethane | 3.5% based on total gelatin on imaging side |

Radiographic Material B (Control):

The layer arrangement and reflective support of Material B were like that for Material A and contained the same green-light sensitive emulsion ingredients and overcoat except that hydroquinone and 4-methyl-4'-hydroxymethyl-1-phenyl pyrazolidone were omitted. The emulsion coated on one side of the reflective support contained a "run-iodide MIF ammonia-ripened oxidized gelatin" having silver iodobromide tabular grains dispersed therein (aspect ratio of 30). The iodide was added during grain growth as a 3.5 mol % vAg-controlling iodobromide salt, starting at the beginning of growth (1.7% of silver run) to 85% of the silver run. This provided iodide in a localized portion of the grains of 1.7 to 85% where 100% refers to the grain surface. The remainder of the emulsion grains was comprised of silver bromide.

Radiographic Material C (Invention):

Material C was a reflective radiographic material with a single blue-light sensitive silver halide emulsion layer disposed on one side only of a reflective support (same as for Material A). The emulsion layer contained tabular silver halide grains that were prepared and dispersed in deionized oxidized gelatin that had been added at multiple times before and/or during the nucleation and early growth of the silver bromide tabular grains dispersed therein. The tabular grains had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with aurousdithiosulfate, sodium thiocyanate, and potassium selenocyanate using conventional procedures. Spectral sensitization to the "blue" (420–480 nm) region was provided using a 50:50 molar blend of spectral sensitizing dyes SS-1 and SS-2 identified below. The total amount of spectral sensitizing dyes was 500 mg per mole of silver.

(SS-1)

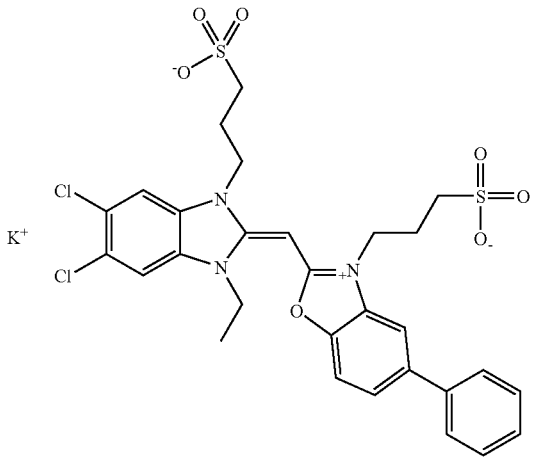

(SS-2)

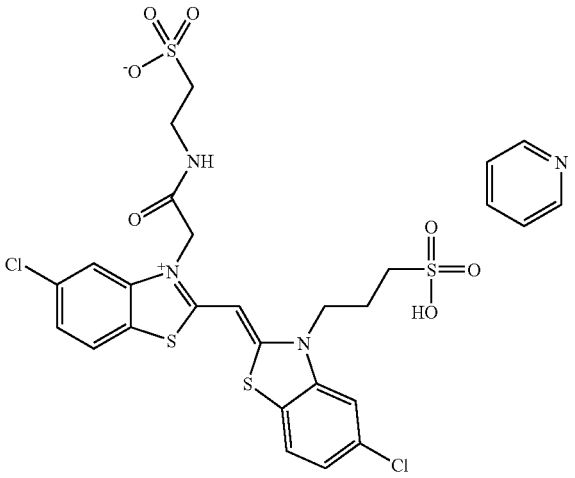

Material C had the following layer arrangement and formulations of the reflective support:

Overcoat

Emulsion Layer

Reflective Support

| | Coverage (mg/dm$^2$) |
|---|---|
| Overcoat Formulation | |
| Gelatin vehicle | 10.8 |
| TRITON ® X-200E surfactant | 0.28 |
| Olin 10G surfactant | 0.74 |
| Emulsion Layer Formulation | |
| Tabular grain emulsion [AgIBr 1.5:98.5 mole halide ratio, 3.0 μm avg. dia. × 0.12 μm thickness] | 16.1 |
| Oxidized gelatin vehicle | 2.5 |
| Non-oxidized gelatin vehicle | 22.8 |
| 5-Bromo-4-hydroxy-6-methyl-1,3,3a,7-tetraazaindene | 0.03 |
| Hydroquinone | 11.7 |
| 4-methyl-4'-hydroxymethyl-1-phenyl pyrazolidone | 0.1 |
| TRITON ® X-200E surfactant | 0.3 |
| Oxiranemethanol, polymer with nonylphenol | 0.9 |
| Bisvinylsulfonylmethane | 3.5% based on total gelatin on imaging side |

Reflective Material D (Control):

The layer arrangement and reflective support of Material D were like that for Material C and contained the same blue-light sensitive emulsion ingredients and overcoat except that hydroquinone and 4-methyl-4'-hydroxymethyl-1-phenyl pyrazolidone were omitted.

Reflective Material E (Invention):

Material E was a green-light sensitive reflective radiographic material that had the following layer arrangement and formulations of the reflective support:

Overcoat

Interlayer

Emulsion Layer

Reflective Support

The noted layers were prepared from the following formulations:

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Spermafol | 0.15 |
| Interlayer Formulation | |
| Gelatin vehicle | 3.4 |

-continued

| | Coverage (mg/dm$^2$) |
|---|---|
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| Tabular grain emulsion [AgBr 2.9 μm avg. dia. × 0.10 μm thickness] | 16.1 |
| Gelatin vehicle | 26.3 |
| 4-Hydroxy-6-methyl-1,3,3a,7-tetraazaindene | 2.1 g/Ag mole |
| Hydroquinone | 11.7 |
| 4-methyl-4'-hydroxymethyl-1-phenyl pyrazolidone | 0.1 |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethane | 2% based on total gelatin in all layers on each side |

Reflective Material F (Control):

The layer arrangement and reflective support of Material F were like that for Material E and contained the same green-light sensitive emulsion ingredients, interlayer, and overcoat except that hydroquinone and 4-methyl-4'-hydroxymethyl-1-phenyl pyrazolidone were omitted.

Samples of the green-sensitive reflective radiographic materials (A, B, E, and F) were exposed, through a graduated density step tablet, to a 500 watt General Electric DMX projector lamp in a Macbeth sensitometer for $1/50^{th}$ second, calibrated to 2650° K., filtered with a Corning C4010 filter to simulate a green-light emitting phosphor from a green-emitting fluorescent intensifying screen.

Samples of the blue-sensitive reflective radiographic materials (C and D) were exposed using a Corning filter to simulate a blue-emitting phosphor in a blue-light emitting fluorescent intensifying screen.

After exposure, the samples of reflective radiographic materials were in contact with the activator solution for about 60 seconds at 20° C. and either fixing composition for about 60 seconds at 20° C. Except for the Control RP X-OMAT® developer, no black-and-white developer solutions were used. The samples were then washed with water at 20° C. for about 60 seconds.

The resulting $D_{min}$, $D_{max}$ and dynamic range data are shown in the following TABLE I.

TABLE I

| Radiographic Material | Fixing Comp. 1 $D_{min}$ | Fixing Comp. 1 $D_{max}$ | Fixing Comp. 1 Dynamic Range | Fixing Comp. 2 $D_{min}$ | Fixing Comp. 2 $D_{max}$ | Fixing Comp. 2 Dynamic Range | RP X-OMAT ® Dynamic Range |
|---|---|---|---|---|---|---|---|
| A (Invention) | 0.22 | 1.69 | 1.47 | 0.55 | 1.68 | 1.13 | 1.50 |
| B (Control) | 0.10 | 0.10 | 0 | 0.10 | 0.10 | 0 | 1.39 |
| C (Invention) | 0.25 | 1.65 | 1.40 | 0.31 | 1.67 | 1.36 | 1.41 |
| D (Control) | 0.10 | 0.10 | 0 | 0.11 | 0.11 | 0 | 1.14 |
| E (Invention) | 0.32 | 1.60 | 1.28 | 0.53 | 1.68 | 1.15 | 1.45 |
| F (Control) | 0.10 | 0.10 | 0 | 0.10 | 0.10 | 0 | 1.31 |

These data show that the use of an activator solution and Fixing Composition 1 or 2 provided acceptable $D_{min}$, $D_{max}$, and dynamic range results with the reflective radiographic materials that contained an incorporated black-and-white developing agent. These dynamic range results were not too different from those obtained using the conventional radiographic film RP X-OMAT® processing chemistry.

EXAMPLES 2–5

One-Step Methods Using Thiosulfate Fixing Agent

The following activator-fixing compositions of the present invention were prepared:

| | |
|---|---|
| Activator-Fixing Composition (Example 2): | |
| Potassium bromide | 0.012 mol/l |
| Potassium hydroxide | 1.2 mol/l |
| Ethylenediaminetetraacetic acid (EDTA) | 1 g/l |
| Sodium sulfite | 0.09 mol/l |
| Sodium thiosulfate | 0.15 mol/l |
| pH | >13 |
| Activator-Fixing Composition (Example 3): | |
| Potassium bromide | 0.006 mol/l |
| Potassium hydroxide | 0.6 mol/l |
| Ethylenediaminetetraacetic acid (EDTA) | 0.4 g/l |
| Sodium sulfite | 0.045 mol/l |
| Sodium thiosulfate | 0.072 mol/l |
| pH | >13 |
| Activator-Fixing Composition (Example 4): | |
| Potassium bromide | 0.003 mol/l |
| Potassium hydroxide | 0.2 mol/l |
| Ethylenediaminetetraacetic acid (EDTA) | 0.022 mol/l |
| Sodium sulfite | 0.022 mol/l |
| Sodium thiosulfate | 0.036 mol/l |
| pH | >13 |
| Activator-Fixing Composition (Example 5): | |
| Potassium bromide | 0.0015 mol/l |
| Potassium hydroxide | 0.15 mol/l |
| Ethylenediaminetetraacetic acid (EDTA) | 0.1 g/l |
| Sodium sulfite | 0.011 mol/l |
| Sodium thiosulfate | 0.017 mol/l |
| pH | >13 |

Samples of the reflective radiographic materials A through F were exposed as described in Example 1 and processed using each of the "activator-fixing" compositions described above. The samples were in contact with each activator-fixing composition for about 60 seconds at 20° C. The processed samples were then washed with water at 20° C. for about 30 seconds. No black-and-white developer solutions were used. Thus, there were no separate activation and fixing steps.

The following TABLES II and III show the resulting $D_{min}$, $D_{max}$, and dynamic range data.

TABLE II

| Radiographic Material | Example 2 $D_{min}$ | Example 2 $D_{max}$ | Example 2 Dynamic Range | Example 3 $D_{min}$ | Example 3 $D_{max}$ | Example 3 Dynamic Range |
|---|---|---|---|---|---|---|
| A (Invention) | 0.23 | 1.42 | 1.19 | 0.22 | 1.53 | 1.31 |
| B (Control) | 0.10 | 0.10 | 0 | 0.10 | 0.10 | 0 |
| C (Invention) | 0.40 | 1.42 | 1.02 | 0.36 | 1.52 | 1.16 |
| D (Control) | 0.11 | 0.11 | 0 | 0.11 | 0.11 | 0 |
| E (Invention) | 0.37 | 1.37 | 1.00 | 0.23 | 1.49 | 1.26 |
| F (Control) | 0.10 | 0.10 | 0 | 0.10 | 0.10 | 0 |

TABLE III

| Radiographic Material | Example 4 $D_{min}$ | Example 4 $D_{max}$ | Example 4 Dynamic Range | Example 5 $D_{min}$ | Example 5 $D_{max}$ | Example 5 Dynamic Range |
|---|---|---|---|---|---|---|
| A (Invention) | 0.22 | 1.60 | 1.38 | 0.31 | 1.59 | 1.28 |
| B (Control) | 0.10 | 0.10 | 0 | 0.10 | 0.10 | 0 |
| C (Invention) | 0.36 | 1.44 | 1.08 | 0.36 | 1.29 | 0.93 |
| D (Control) | 0.10 | 0.10 | 0 | 0.10 | 0.10 | 0 |
| E (Invention) | 0.23 | 1.46 | 1.23 | 0.27 | 1.24 | 0.97 |
| F (Control) | 0.10 | 0.10 | 0 | 0.10 | 0.10 | 0 |

These data show reasonable dynamic range results (>1.00) were obtained using the reflective radiographic materials even at lower concentrations of fixing agent (thiosulfate) and lower concentrations of hydroxide. Adequate activation and fixing can be achieved over a wide range of constituent concentrations.

EXAMPLES 6–8

One-Step Methods Using Cysteine Fixing Agent

The following activator-fixing compositions of the present invention were prepared:

| | |
|---|---|
| Activator-Fixing Composition (Example 6): | |
| Potassium bromide | 0.04 mol/l |
| Potassium hydroxide | 1.8 mol/l |
| Ethylenediaminetetraacetic acid (EDTA) | 1 g/l |
| Sodium sulfite | 0.12 mol/l |
| Cysteine | 0.14 mol/l |
| pH | >13 |

-continued

| Activator-Fixing Composition (Example 7): | |
|---|---|
| Potassium bromide | 0.02 mol/l |
| Potassium hydroxide | 1.8 mol/l |
| Ethylenediaminetetraacetic acid (EDTA) | 1 g/l |
| Sodium sulfite | 0.12 mol/l |
| Cysteine | 0.12 mol/l |
| pH | >13 |
| **Activator-Fixing Composition (Example 8):** | |
| Potassium bromide | 0.004 mol/l |
| Potassium hydroxide | 0.35 mol/l |
| Ethylenediaminetetraacetic acid (EDTA) | 0.3 g/l |
| Sodium sulfite | 0.002 mol/l |
| Cysteine | 0.022 mol/l |
| pH | >13 |

Samples of the reflective radiographic materials A through F were exposed as described in Example 1 and processed using each of the "activator-fixing" compositions described above. The samples were in contact with each activator-fixing composition for about 60 seconds at 20° C. The processed samples were then washed with water at 20° C. for about 30 seconds. No black-and-white developer solutions were used. Thus, there were no separate activation and fixing steps.

The following TABLE IV shows the resulting $D_{min}$, $D_{max}$, and dynamic range data.

TABLE IV

| Radiographic Material | Example 6 $D_{min}$ | Example 6 $D_{max}$ | Example 6 Dynamic Range | Example 7 $D_{min}$ | Example 7 $D_{max}$ | Example 7 Dynamic Range | Example 8 $D_{min}$ | Example 8 $D_{max}$ | Example 8 Dynamic Range |
|---|---|---|---|---|---|---|---|---|---|
| A (Invention) | 0.10 | 1.72 | 1.62 | 0.11 | 1.75 | 1.64 | 0.24 | 1.77 | 1.53 |
| B (Control) | 0.10 | 0.10 | 0 | 0.10 | 0.10 | 0 | 0.10 | 0.10 | 0 |
| C (Invention) | 0.16 | 1.73 | 1.57 | 0.19 | 1.66 | 1.47 | 0.31 | 1.61 | 1.30 |
| D (Control) | 0.10 | 0.10 | 0 | 0.10 | 0.10 | 0 | 0.10 | 0.10 | 0 |
| E (Invention) | 0.11 | 1.68 | 1.57 | 0.23 | 1.68 | 1.45 | 0.27 | 1.65 | 1.38 |
| F (Control) | 0.10 | 0.10 | 0 | 0.10 | 0.10 | 0 | 0.10 | 0.10 | 0 |

These results show good dynamic range and low Dmin due to excellent fixing and clearing with cysteine-containing solutions, even at lower concentrations.

EXAMPLE 9

Activator-Fixing Composition Containing Thiocyanate Fixing Agent

The following activator-fixing composition of the present invention was prepared:

| Activator-Fixing Composition: | |
|---|---|
| Potassium bromide | 0.0017 mol/l |
| Potassium hydroxide | 0.72 mol/l |
| Ethylenediaminetetraacetic acid (EDTA) | 1 g/l |
| Sodium sulfite | 0.10 mol/l |
| Sodium thiocyanate | 0.14 mol/l |
| pH | >13 |

Samples of the reflective radiographic materials A, B, E, and F were exposed as described in Example 1 and processed using the noted "activator-fixing" composition. The samples were in contact with the activator-fixing composition for about 60 seconds at 20° C. The processed samples were then washed with water at 20° C. for about 30 seconds. No black-and-white developer solutions were used. Thus, there were no separate activation and fixing steps. The results from using this composition are shown in TABLE V below.

EXAMPLE 10

Activator-Fixing Composition Containing Thiosalicylic Acid Fixing Agent

The following activator-fixing composition of the present invention was prepared:

| Activator-Fixing Composition: | |
|---|---|
| Potassium bromide | 0.017 mol/l |
| Potassium hydroxide | 0.72 mol/l |
| Ethylenediaminetetraacetic acid (EDTA) | 1 g/l |
| Sodium sulfite | 0.10 mol/l |
| Thiosalicylic acid | 0.14 mol/l |
| pH | >13 |

Samples of the reflective radiographic materials A, B, E, and F were exposed as described in Example 1 and processed using the noted "activator-fixing" composition. The samples were in contact with the activator-fixing composition for about 60 seconds at 20° C. The processed samples were then washed with water at 20° C. for about 30 seconds. No black-and-white developer solutions were used. Thus, there were no separate activation and fixing steps. The results from using this composition are shown in TABLE V below.

TABLE V

| Radiographic Material | Example 9 $D_{min}$ | Example 9 $D_{max}$ | Example 9 Dynamic Range | Example 10 $D_{min}$ | Example 10 $D_{max}$ | Example 10 Dynamic Range |
|---|---|---|---|---|---|---|
| A (Invention) | 0.41 | 1.57 | 1.16 | 0.55 | 1.58 | 1.03 |
| B (Control) | 0.13 | 0.13 | 0 | 0.13 | 0.13 | 0 |
| E (Invention) | 0.38 | 1.53 | 1.15 | 0.59 | 1.58 | 0.99 |
| F (Control) | 0.14 | 0.14 | 0 | 0.17 | 0.17 | 0 |

The invention has been described in detail with particular reference to certain preferred embodiments thereof, but it will be understood that variations and modifications can be effected within the spirit and scope of the invention.

The invention claimed is:

1. A method of providing a black-and-white image comprising:

A) contacting an exposed black-and-white silver halide material containing an incorporated black-and-white developing agent with an activator composition having a pH of at least 10 and at least 0.05 mol/l of sulfite ions, and B) contacting said exposed silver halide material with a solution comprising a fixing agent other than a sulfite, said solution being free of black-and-white developing agents, wherein steps A and B are carried out simultaneously and said activator composition also comprises said fixing agent.

2. The method of claim 1 wherein steps A and B are carried out simultaneously for at least 30 and up to 90 seconds.

3. The method of claim 1 wherein said fixing agent is a thiosulfate.

4. The method of claim 1 wherein said fixing agent is a thiol-containing fixing agent.

5. The method of claim 4 wherein said organic fixing agent is one or more of cysteine, thiourea, mercaptopyridine, cysteine hydrochloride, 2-aminoethanethiol, 3-aminopropanethiol, cystine, thiosalicylic acid, methionine, thiosalicylic acid, or 2-amino-4-thiobutyric acid.

6. The method of claim 1 wherein said silver halide material comprises hydroquinone or a derivative thereof as said incorporated black-and-white developing agent.

7. The method of claim 1 wherein said silver halide material is a reflective radiographic silver halide material comprising a reflective support.

8. The method of claim 1 wherein said activator composition comprises from about 0.05 to about 0.2 mol/l of sulfite ions.

9. A processing kit comprising:

a. an activator composition comprising at least 0.05 mol/l of sulfite ions and having a pH of at least 10, and b. a fixing composition comprising a fixing agent other than a sulfite, said fixing composition being free of black-and-white developing agents.

10. An activator-fixing composition that, in aqueous form, has a pH of at least 10, comprises at least 0.05 mol/l of sulfite ions and at least 0.05 mol/l of a fixing agent other than a sulfite, and is free of black-and-white developing agents.

11. The composition of claim 10 wherein said fixing agent is a thiosulfate or cysteine.

12. The composition of claim 10 further comprising at least 0.01 mol/l of bromide ions.

13. A radiographic kit comprising:

a. an activator composition comprising at least 0.05 mol/l of sulfite ions and having a pH of at least 10, b. a fixing composition comprising a fixing agent other than a sulfite, said fixing composition being free of black-and-white developing agents, c. a radiographic silver halide material comprising a support that has first and second major surfaces, said radiographic material having disposed on at least one support major surface, one or more hydrophilic colloid layers including a silver halide emulsion layer, said radiographic material also containing an incorporated black-and-white developing agent in one or more of said hydrophilic colloid layers, and d. a phosphor screen.

14. The radiographic kit of claim 13 wherein said radiographic material is a reflective radiographic silver halide material comprising a support that has first and second major surfaces, said reflective radiographic material having disposed on said first major reflective support surface only, said one or more hydrophilic colloid layers including a silver halide emulsion layer.

15. A radiographic kit comprising:

a. an activator-fixing composition that, in aqueous form, has a pH of at least 10, and comprises at least 0.05 mol/l of sulfite ions and a fixing agent other than a sulfite, and is free of black-and-white developing agents, b. a radiographic silver halide material comprising a support that has first and second major surfaces, said radiographic material having disposed on at least one support major surface, one or more hydrophilic colloid layers including a silver halide emulsion layer, said radiographic material also containing an incorporated black-and-white developing agent in one or more of said hydrophilic colloid layers, and c. a phosphor screen.

16. The radiographic kit of claim 15 wherein said radiographic material is a reflective radiographic silver halide material comprising a support that has first and second major surfaces, said reflective radiographic material having disposed on said first major reflective support surface only, said one or more hydrophilic colloid layers including a silver halide emulsion layer.

17. A method of providing a black-and-white image comprising:

A) contacting an exposed black-and-white silver halide material containing an incorporated black-and-white developing agent with an activator composition having a pH of at least 10 and at least 0.05 mol/l of sulfite ions, and B) contacting said exposed silver halide material with a solution comprising a fixing agent other than a sulfite, said solution being free of black-and-white developing agents, wherein steps A and B are carried out sequentially and said black-and-white silver halide material is a reflective radiographic silver halide material comprising a reflective support that reflects at least 80% of incident light, and having one or more photographic silver halide emulsion layers on only one side of said reflective support.

18. The method of claim 17 wherein step A is carried out for at least 30 and up to 120 seconds, and step B is carried out for at least 30 and up to 120 seconds.

19. The method of claim 17 wherein said fixing agent is a thiosulfate.

20. The method of claim 17 wherein said fixing agent is a thiol-containing fixing agent.

21. The method of claim 20 wherein said organic fixing agent is one or more of cysteine, thiourea, mercaptopyridine, cysteine hydrochloride, 2-aminoethanethiol, 3-aminopropanethiol, cystine, thiosalicylic acid, methionine, thiosalicylic acid, or 2-amino-4-thiobutyric acid.

22. The method of claim 17 wherein said silver halide material comprises hydroquinone or a derivative thereof as said incorporated black-and-white developing agent.

23. The method of claim 17 wherein said activator composition comprises from about 0.05 to about 0.2 mol/l of sulfite ions.

24. The method of claim 17 wherein said radiographic silver halide material further comprises at least one non-light-sensitive hydrophilic layer with said one or more photographic silver halide emulsion layers.

25. The method of claim 17 wherein said one or more photographic silver halide layers comprise at least 0.05% of oxidized gelatin based on the total dry weight of hydrophilic polymeric vehicles.

* * * * *